United States Patent [19]

Suttles

[11] 4,401,221

[45] Aug. 30, 1983

[54] FORWARD FEED MERCHANDISING DEVICE FOR SOFT DRINK BOTTLES

[75] Inventor: James M. Suttles, Elberton, Ga.

[73] Assignee: The Mead Corporation, Atlanta, Ga.

[21] Appl. No.: 116,977

[22] Filed: Jan. 30, 1980

[51] Int. Cl.[3] ..... A47F 5/00

[52] U.S. Cl. ..... 211/49 D; 211/74

[58] Field of Search ..... 211/74, 75, 49 D; 52/473, 507, 762

[56] References Cited

U.S. PATENT DOCUMENTS

| | | | |
|---|---|---|---|
| 2,218,444 | 10/1940 | Vineyard . | |
| 2,620,691 | 12/1952 | Gould | 211/74 |
| 2,772,787 | 12/1956 | Lee | 211/75 |
| 2,919,814 | 1/1960 | Berkowitz | 211/74 |
| 2,954,128 | 9/1960 | Gordon | 211/49 D |
| 3,243,220 | 1/1971 | Anglade | 208/427 |
| 3,643,808 | 2/1972 | Ryan et al. | 211/49 D |
| 4,008,810 | 2/1977 | Merz | 211/74 |
| 4,095,385 | 6/1978 | Bragman | 52/762 |
| 4,128,177 | 12/1978 | Bustos | 211/49 D |
| 4,243,145 | 1/1981 | Woodhead | 211/49 D |
| 4,310,097 | 1/1982 | Merl | 211/49 D |
| 4,318,485 | 3/1982 | Clement | 211/49 D |

FOREIGN PATENT DOCUMENTS

| | | | |
|---|---|---|---|
| 259169 | 2/1965 | Australia | 211/74 |

*Primary Examiner*—William F. Pate, III

*Attorney, Agent, or Firm*—Howson and Howson

[57] ABSTRACT

A merchandising device for bottles having integrally formed externally projecting neck rings comprising track means providing a pair of substantially parallel supporting surfaces having opposed edges spaced from each other to form a slot of substantially uniform width adapted to receive the necks of said bottles underneath said neck rings, and means for supporting said track means in a fixed position, is characterized by the fact that said track means comprises at least one elongated element having a web having parallel edges extending in the direction of its length, a first flange extending in one direction substantially perpendicularly from one of said parallel edges, and a second flange extending in the opposite direction substantially perpendicularly from the other of said parallel edges, the flanges being of different width transverse to the direction of elongation, and by the fact that said supporting means and said track means include means for supporting said elongated element in a first position in which its first flange serves as one of said substantially parallel supporting surfaces and in a second position in which its second flange serves as one of said substantially parallel supporting surfaces, whereby bottles having different neck widths can be accommodated. The device is also characterized by the fact that each of the supporting surfaces comprises a downwardly sloping portion for effecting feed of bottles by gravity, an upwardly sloping portion for retarding movement of the bottles, and an upwardly extending tab for positively stopping the bottles by engagement with their neck rings.

11 Claims, 6 Drawing Figures

FORWARD FEED MERCHANDISING DEVICE FOR SOFT DRINK BOTTLES

BRIEF SUMMARY OF THE INVENTION

This invention relates to merchandising devices for soft drink bottles, and particularly to a gravity-feed merchandising device in which soft drink bottles are suspended by their necks and carried forward by gravity on an inclined track.

Various approaches have been taken in the past in gravity-feed soft drink merchandising devices. In one category of merchandising devices, exemplified by Vineyard U.S. Pat. No. 2,218,444, dated Oct. 15, 1940 and by Bustos U.S. Pat. No. 4,128,177, dated Dec. 5, 1978, bottles are arranged on an inclined track, and allowed to move forward under the action of gravity until the foremost bottle reaches a bumper rail. In the Vineyard patent, the bottles are supported by and slide on an inclined surface. In the Bustos patent, the bottles rest on a conveyor belt, which, in turn, slides on an inclined surface. In either case, because of the fact that the bottles are supported from underneath, the bumper rail has to be of a sufficient height to insure that the bottles do not tip forward and fall on the floor when they each the front end of the track. The relatively high bumper rails give rise to the need for an excess spacing between shelves on a multiple-shelf merchandiser in order to enable the customer to remove bottles.

The need for a high bumper rail is eliminated in the merchandisers described in application Ser. No. 026,956, filed Apr. 4, 1979 by John L. Williams, and in application Ser. No. 026,957, filed Apr. 4, 1979 by John L. Williams and Asa V. Brown, Jr. In the former application, the bottles are supported on a conveyor belt, which is in turn supported on an inclined surface. At the lower end of the inclined surface a ramp is provided in order to produce a gradual slowing of the column of bottles. In the Williams and Brown application, frictional pads, located underneath the belt at the forward end are used for substantially the same purpose. The gradual slowing of the bottles eliminates the need for a high bumper rail, and enables the shelves on a multiple shelf display to be placed closer together, for a more efficient use of space.

In Suttles U.S. application Ser. No. 065,931, filed Aug. 13, 1979, a merchandiser is described in which a spring device gently urges columns of bottles in a forward direction. Because the bottles are urged gently, a relatively low front barrier can be used or alternatively, a ramp or frictional retarder can be used.

Unfortunately, the performance of the forward feed merchandisers described in the above pending applications is affected to some extent by the presence of dirt and dust, by humidity, and by temperature changes. To eliminate the need for bumper rails, while avoiding the problems associated with dirt, humidity and temperature changes, Joseph J. Clement, in his application Ser. No. 109,061, filed Jan. 2, 1980 describes a device in which bottles are suspended by their necks on an inclined track. The manner in which the bottles are suspended in the Clement apparatus is similar to the manner in which bottles are suspended in the well-known soft drink vending machines having a series of parallel metal rails arranged to provide parallel slots for holding bottles underneath their neck rings. The Clement apparatus takes advantage of the fact that soft drink bottles, as currently manufactured, have externally projecting neck rings, which are well-suited for engagement with track means having a pair of substantially parallel supporting surfaces with opposed edges spaced from each other to form an elongated slot of substantially uniform width. In the Clement apparatus, the major portion of the track is inclined downwardly to effect feeding by gravity, while the forward end of the track is inclined upwardly in order to cause the bottles to come to a gradual stop at the forward end of the track.

This system, described in the Clement application, has the disadvantage that the position of the foremost bottle in a column varies depending upon the number of bottles in the column. It also has the disadvantage that the foremost bottle in a column may accidentally become disengaged from the front end of the track.

Another disadvantage of the Clement apparatus arises from the fact that plastic soft drink bottles are currently available in two standard sizes, namely 28 mm. and 38 mm., these dimensions referring to the neck diameters. In accordance with the Clement application, there are two ways in which to accommodate two sizes of bottles. The first is to provide detachable plastic strips which can be pressed onto the opposed edges of a track to narrow the width of the track slot. The other is to provide a multiple track unit which has tracks on the bottom and tracks on the top and which can be turned upside down to change the slot width of the tracks which are in use. The former solution requires auxiliary parts, and the latter solution results in a track unit which is heavy and which takes up excess vertical space.

The principal object of this invention is to overcome one or both of the foregoing difficulties inherent in the Clement merchandiser. Specifically, it is an object of this invention to provide a merchandising device which supports soft drink bottles by the neck, and which insures that the foremost bottle of a column is stopped at a predetermined position regardless of the number of bottles in the column behind the foremost bottle. It is also an object of the invention to provide a simple merchandising device of the neck-suspension type which is capable of being modified readily in order to accommodate bottles of various neck diameters and which takes up a relatively small amount of vertical space.

It is also an object of the invention to allow bottles to be removed from the merchandiser easily and at the same time to prevent bottles from becoming disengaged from the front end of the merchandiser tracks accidentally.

A further object of the invention is the provision of a merchandiser of the neck-suspension type having an extremely simple construction, and which is easy and inexpensive to manufacture.

The track in accordance with the invention has a pair of substantially parallel supporting surfaces having opposed edges spaced from each to form an elongated slot of substantially uniform width adapted to receive the necks of the bottles underneath their neck rings. In order to insure that the foremost bottle of a column is stopped at a predetermined position regardless of the number of bottles in the column, the track is configured so that each of the supporting surfaces comprises a downwardly sloping portion for effecting feed of the bottles by gravity, an upwardly sloping portion following the downwardly sloping portion in the direction of feed for retarding the movement of the bottles, and positive stop means for effecting stoppage of a bottle by engagement with its neck ring. The positive stop means comprises a tab, integral with and extending upwardly from the sloping portion of the track. For removal, a bottle must be lifted so that its neck ring clears the tab. With this arrangement, in a merchandising device having multiple tracks, the foremost bottles in all of the tracks are automatically arranged nearly at the front of the merchandiser, regardless of the number of bottles in the tracks.

To accommodate bottles having different neck diameters, the merchandising device in accordance with the invention is constructed so that the widths of the slots in the individual tracks can be readily changed. Each track comprises at least one removable elongated element having first and second flanges of different widths measured in directions transverse to the direction of elongation. The track means and its supporting means include means for removably supporting the elongated element in a first position in which its first flange serves as one of the substantially parallel supporting surfaces and in a second position in which its second flange serves as one of the substantially parallel supporting surfaces. A simple reversal of the track element, therefore, is all that is required to change the slot width.

In its preferred form, each elongated track element comprises a web having two parallel edges extending in the direction of its length. The first and second flanges extend substantially perpendicularly from the respective edges of the web. Preferably, these flanges extend in opposite directions to produce a Z-shaped element. This latter arrangement enables the supporting means to engage the underside of the unused flange, and to engage at the same time the side of the web underneath the unused flange. A tab on the support extends through an opening in the unused flange to prevent lateral movement of the element. In this way, so long as bottles are present in the track, the track element is locked against both lateral translational and rotational movement.

Still another refinement in accordance with the invention is the provision of means for preventing the unused flange of the elongated track element from being moved upwardly so long as bottles are present in the track. Where the merchandising device has two transverse track support elements, this arrangement prevents the weight of a bottle at the front of an otherwise empty track from causing the track element to lift away from the rear support element.

Other features and advantages of the invention will be apparent from the following detailed description, when read in conjunction with the drawings.

DETAILED DESCRIPTION

Figure 1:
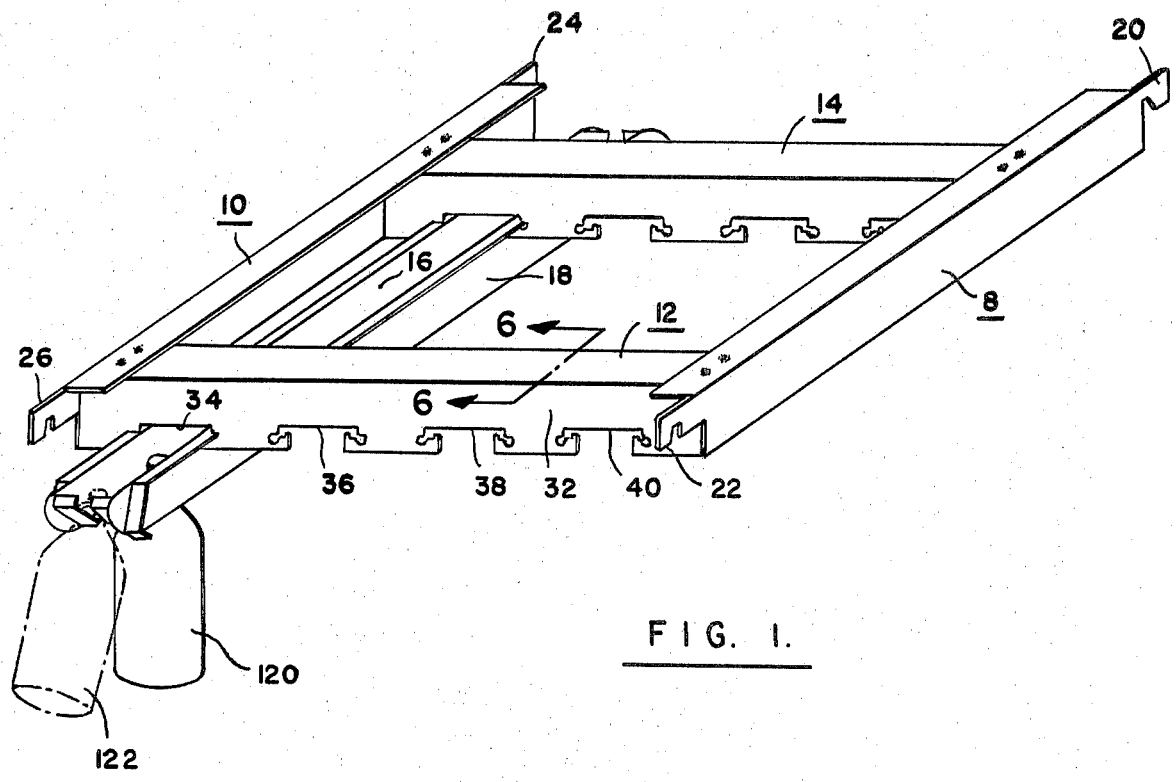
FIG. 1 is an oblique perspective view showing a track support unit in accordance with the invention with a track installed in it comprising a pair of track members.

A beverage display stand or "merchandiser" in accordance with the invention comprises one or more track support units of the kind shown in FIG. 1 removably mounted on a rack (not shown). The rack can be a conventional four-post rack or alternatively a rack consisting of a base having a vertically extending back wall on which the track support units are cantilevered. In general, each merchandiser will have several track support units arranged one above another.

The track support unit in FIG. 1 is designed for use in a four-post rack. It is formed entirely of sheet metal, and comprises side members 8 and 10, cross members 12 and 14, and a number of tracks, only one of which is shown. The track comprises removable track members 16 and 18.

Side members 8 and 10 have an inverted L-shaped transverse cross-section. Hooks are formed at the ends of the side members at 20, 22, 24 and 26. These hooks are adapted to engage slots in the four-post rack. If desired, in a four-post system, the side members can be identical to each other since the front and rear hooks can be symmetrical. When the track support is designed for use in a rack having a back extending upwardly from the rear of a base, the side members are designed differently, and are provided with special slot-engaging tabs such as those shown in Suttles U.S. Pat. No. 3,983,822, dated Oct. 5, 1976.

Figure 6:
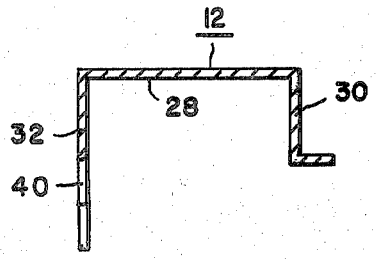
FIG. 6 is a vertical section of a support member taken on the plane 6—6 indicated in FIG. 1.

Transverse elements 12 and 14 are preferably identical, and have cross-sections of the shape shown in FIG. 6. Elements 12 and 14 extend between side elements 8 and 10, and are secured underneath the horizontal flanges of elements 8 and 10 by spot welding, or by suitable fasteners. Transverse element 12 is positioned near the front of the track support unit, while transverse element 14 is positioned near the rear of the unit.

The transverse elements support the track elements so that the tracks slope downwardly and forwardly at a small angle, e.g. 10 degrees, to allow bottles to be carried to the front of the track by gravity.

Referring to FIG. 6, each transverse element of the track support unit comprises a horizontal web 28 for attachment to the side elements, a rear, L-shaped reinforcing flange 30, and a depending front flange 32. As shown in FIG. 1, flange 32 of transverse element 12 is provided with a series of evenly spaced slots of complex shape. The slots in element 12 are indicated at 34, 36, 38 and 40.

Figure 5:
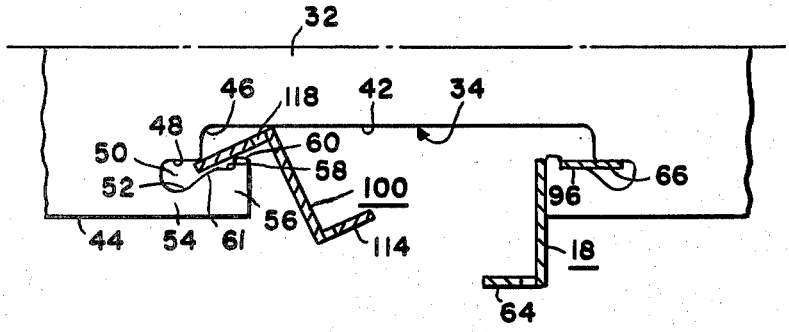
FIG. 5 is a transverse section of a track illustrating the manner in which the track elements are installed and removed.

The complex shape of the slots is best seen in FIG. 5, which shows the details of slot 34. Slot 34 comprises a horizontal edge 42 which is parallel to and spaced upwardly from lower edge 44 of flange 32. At its left-hand end, flange 32 curved downwardly at 46, to meet another horizontal, downwardly facing edge 48, which is positioned at a level below edge 42. Horizontal edge 48 is the upper boundary of an opening 50, the lower boundary of which, at 52, is the upper edge of a horizontal extension 54. At the right-hand end of horizontal extension 54, there is provided a vertical extension 56 having a horizontal upper edge 58, and an upwardly extending tab 60.

Preferably, the left-hand edge 61 of extension 56 extends obliquely from lower boundary 52 of opening 50 to horizontal edge 58. Horizontal edge 58 is positioned at a level below the level of downwardly facing edge 48, the vertical spacing between these two edges being equal to the thickness of the sheet metal from which the track elements are made. Opening 50 should be large enough to provide clearance for the larger of the two track element flanges.

The configuration of the right-hand end of slot 34 is a mirror image of the configuration of the left-hand end, and need not be separately described.

Figure 2:
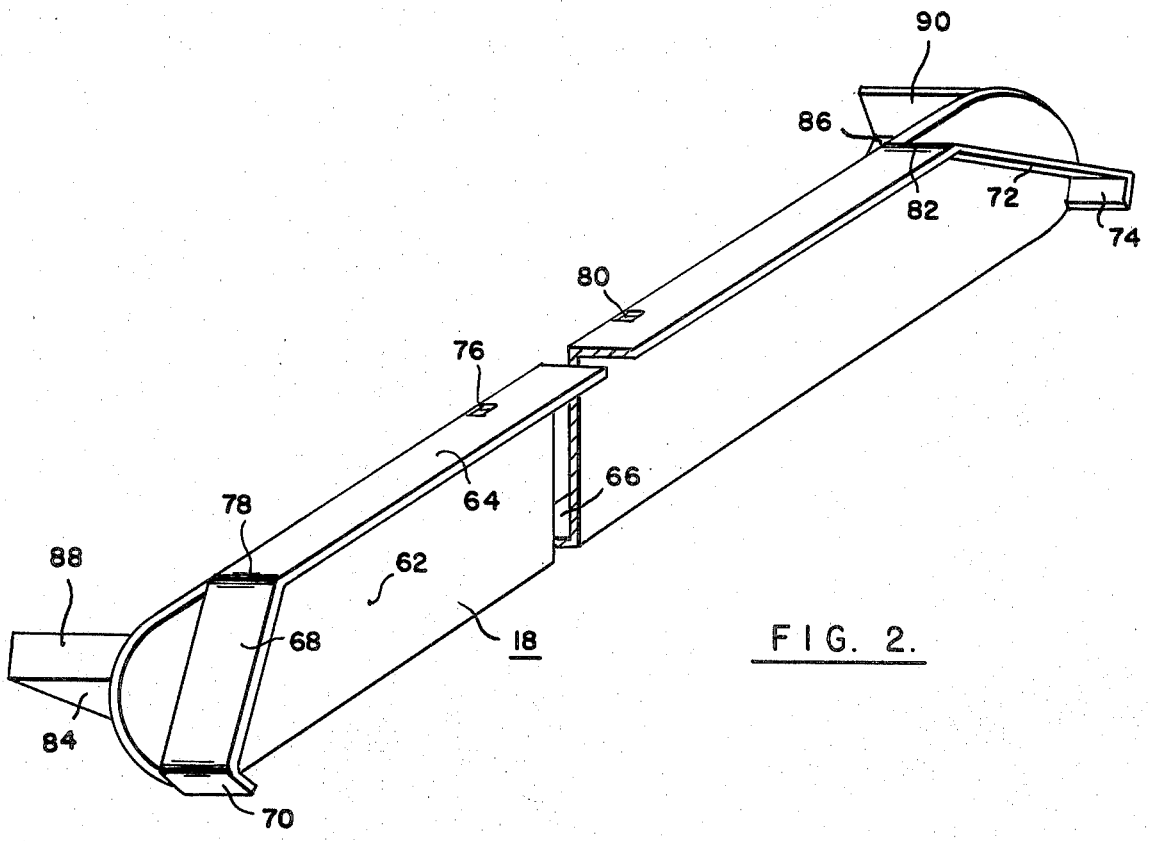
FIG. 2 is an oblique perspective view of a single track member.

The two track elements 16 and 18 are preferably identical, and track element 18 is shown in detail in FIG. 2. The track element is formed from a unitary piece of sheet metal, and comprises a vertical web 62 having a first flange 64 extending perpendicularly from its upper edge, and a second flange 66 extending perpendicularly from its lower edge in the opposite direction. Thus, throughout most of its length, the track element has a Z-shaped cross-section. Flange 66 is wider than flange 64.

At the front end of track element 18, flange 64 is separated from the upper edge of the web, and is bent downwardly at 78 to form an obtuse angle (e.g. approximately 138°) with the main part of flange 64 to provide a ramp 68. Ramp 68 terminates in a flange 70 which is substantially perpendicular to ramp 68, and extends downwardly therefrom. A similar ramp 72 is formed at the opposite end of flange 64, and terminates in a downwardly extending flange 74.

Flange 64 is provided with a small opening 76 spaced a short distance from bend 78. Opening 76 is positioned adjacent web 62. A similar opening 80 in flange 64 is spaced from bend 82 by a distance equal to the spacing between opening 76 and bend 78.

Wide flange 66 on the opposite side of the track member is similarly bent to provide ramps 84 and 86, which terminate respectively in flanges 88 and 90. Flange 66 is also provided with openings (not shown) corresponding to openings 76 and 80, and the openings in flange 66 are at the same longitudinal positions as openings 76 and 80.

Figure 3:
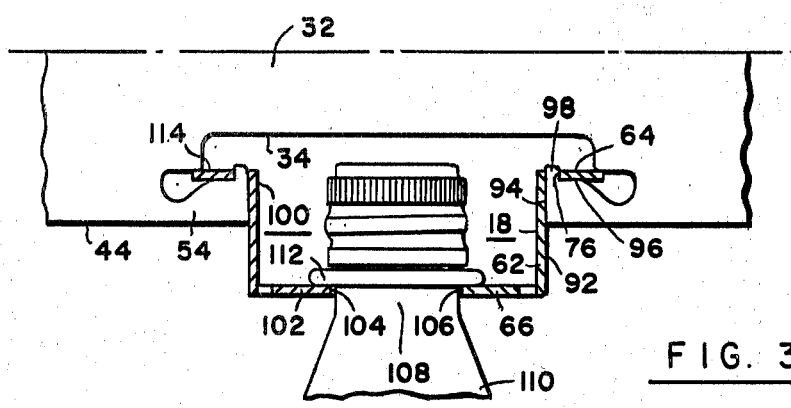
FIG. 3 is a transverse section of a track showing the manner in which the track members cooperate with the support and with a bottle.

FIG. 3 shows track element 18 installed in slot 34. The right-hand face 92 of web 62 bears against vertical edge 94, while the underside of flange 64 bears against horizontal edge 96. Tab 98 extends upwardly through opening 76. A similar track element 100 is supported on the opposite side of slot 34 in the same manner. Flanges 66 and 102 of the respective track elements have parallel edges 104 and 106 which form a slot for receiving the neck 108 of bottle 110. Bottle 110 has an outwardly projecting annular neck ring 112, which extends beyond edges 104 and 106, thereby permitting the bottle to be supported by engagement of neck ring 112 with the upwardly facing sides of flanges 102 and 66. The weight of the bottle causes face 92 of web 62 to bear against vertical edge 94, while the engagement of tab 98 in opening 76 prevents the web from rotating away from edge 94. The weight on track element 18 is supported by edge 96.

Figure 4:
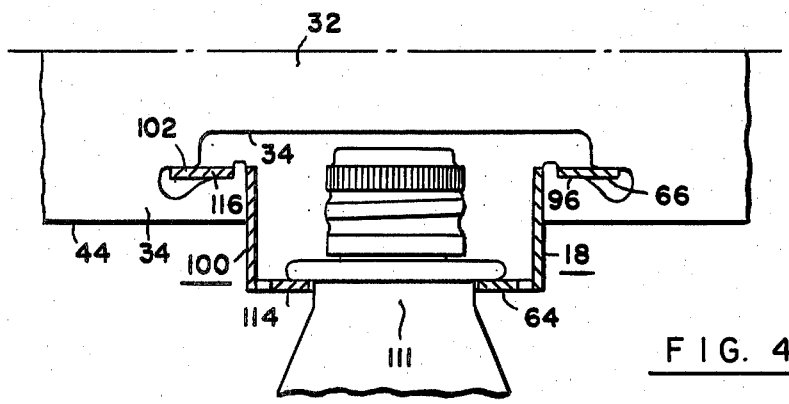
FIG. 4 is a transverse section similar to FIG. 3 except that the track elements are reversed in order to accommodate a larger bottle.

In FIG. 4, track elements 18 and 100 are reversed. A larger bottle 111 rests on shorter flanges 64 and 114, while longer flanges 102 and 66 engage surfaces 116 and 96 to provide vertical support.

By simply reversing the track elements, the track can be modified to accommodate larger bottles such as bottle 111.

As shown in FIG. 5, a track element, such as element 100, is easily installed by tilting the track element, and causing its upper flange to enter opening 50, and thereafter rotating the track element until tab 60 enters opening 118. The manipulation of the track element in installation, of course, also involves the engagement of the track element in a similar manner with the rear transverse track support element 14 (FIG. 1).

Returning to FIG. 1, soft drink bottle 120 is shown held in the track comprising track elements 16 and 18. As bottle 120 slides down the track, it will normally reach the position indicated by bottle 122, which is shown in broken lines. The bottles behind the foremost bottle in a track cause the foremost bottle to assume the tilted position indicated at 122. The bottle at 122 is removed by a customer simply by lifting it upwardly in order to cause its neck ring to clear the upwardly extending tabs at the ends of the ramps. By reason of the presence of the ramps and the tabs at the ends of the ramps, the bottle behind the foremost bottle is prevented from causing accidental disengagement of the foremost bottle from the track.

An important aspect of the invention is the prevention of a "see-saw" effect, which could cause accidental disengagement of the removable track elements from their supports when a single bottle is positioned at the front of the track. The weight of a bottle positioned forward of front cross member 12 causes the track elements to tend to pivot about the front cross member. The rear ends of the track elements are urged upwardly with a resulting tendency for the track elements to become disengaged from the rear cross member 14. Such disengagement is prevented by reason of the fact that the upper flange of each track element is in engagement with a downwardly facing edge corresponding to edge 48 in FIG. 5. So long as at least one bottle is present in the track, the engagement between the upper flange and the downwardly facing edge is maintained. Consequently, the track elements of a particular track cannot be removed from the track support unit until all of the bottles are removed from the track.

In summary, the merchandising device in accordance with the invention has numerous advantages including its structural simplicity, ease of manufacture, ease of conversion to accommodate bottles with different neck sizes, its small vertical space requirement, the ease with which bottles can be removed from its tracks, the prevention of accidental removal of bottles, and the simple manner in which the track elements are locked in place so long as bottles are present in the track. The device gives rise to a number of additional advantages not previously mentioned. For example, since the slot widths of the tracks can be changed individually, this merchandising device gives the merchant a high degree of flexibility; he can place large-necked and small-necked bottles on adjacent tracks if he so chooses. It is possible to accommodate three different sizes of bottles with two identical track elements of the type shown in FIG. 2. It is also possible to accommodate four different bottle sizes, using a pair of non-identical track elements.

If a completely new bottle is made available on the market, it can be accommodated simply by providing new track elements, without the need for replacing the entire track unit of FIG. 1.

For ease of manufacture, the entire track unit of FIG. 1 can be constructed from elements of only three different types, since elements 12 and 14 can be identical, elements 8 and 10 can be identical, and elements 16 and 18 can be identical.

While the preferred embodiment of the invention has been shown and described, various modifications can be made to it. For example, with suitable modifications of the track support slots, the track elements can be made with cross-sectional shapes other than the Z-shaped shown. For example, the track elements can be L-shaped, in which event the two legs of the L are usable alternatively as supporting surfaces for the neck rings of the bottles. The track elements can also be C-shaped. These and still other modifications may be made without departing from the scope of the invention as defined in the following claims.

I claim:

1. A merchandising device for bottles having integrally formed externally projecting neck rings comprising track means providing a pair of substantially parallel supporting surfaces having opposed edges spaced from each other to form an elongated slot of substantially uniform width adapted to receive the necks of the bottles in a column of bottles underneath their neck rings, and means for supporting said track means in a fixed position, characterized by the fact that the slot has an open discharge end permitting bottles to be removed from the slot, by the fact that each of said supporting surfaces comprises a downwardly sloping portion for effecting feed of bottles toward the discharge end by gravity and an upwardly sloping portion following said downwardly sloping portion in the direction of feed of bottles, and by stop means comprising two tabs, one tab projecting upwardly from the upwardly sloping portion of one of said parallel supporting surfaces and the other tab projecting upwardly from the upwardly sloping portion of the other of said parallel supporting surfaces for effecting stoppage of a bottle by engagement of its neck ring with said tabs, said tabs projecting upwardly from their respective upwardly sloping portions at angles such as to effect positive stoppage of the foremost bottle in a column of bottles at a predetermined position regardless of the number of bottles in the column, and said tabs projecting upwardly from their respective upwardly sloping portions to an extent such that for removal, a bottle must be manually lifted so that its neck ring clears the tabs.

2. A merchandising device according to claim 1 in which each tab of the positive stop means is integral with the upwardly sloping portion from which it projects.

3. A merchandising device according to claim 1 in which each of said tabs projects upwardly in a substantially perpendicular relationship with the immediately adjacent part of its upwardly sloping portion.

4. A merchandising device for bottles having integrally formed externally projecting neck rings comprising track means providing a pair of substantially parallel supporting surfaces having opposed edges spaced from each other to form a slot of substantially uniform width adapted to receive the necks of said bottles underneath said neck rings, and means for supporting said track means in a fixed position, characterized by the fact that said track means comprises at least one removable elongated element having first and second flanges having different widths measured in directions transverse to the direction of elongation, and by the fact that said supporting means and said track means include means for removably supporting said elongated element in a first position in which its first flange serves as one of said substantially parallel supporting surfaces and in a second position in which its second flange serves as one of said substantially parallel supporting surfaces, whereby bottles having different neck widths can be accommodated.

5. A merchandising device according to claim 4 in which said elongated element comprises a web having two parallel edges extending in the direction of its length, and in which said first flange extends substantially perpendicularly from one of said parallel edges and said second flange extends substantially perpendicularly from the other of said parallel edges.

6. A merchandising device according to claim 5 in which said flanges extend in opposite directions from said web and in which said support means comprises means providing a surface for engaging and supporting the underside of the one of said flanges which is not serving as one of said parallel supporting surfaces, means for engaging the side of said web underneath the last-mentioned flange at least at a location below said engaging and supporting surface, and means for preventing lateral movement of the upper end of said elongated element in a direction away from said side-engaging means.

7. A merchandising device according to claim 5 in which said flanges extend in opposite directions from said web and in which said support means comprises first and second support members both at intermediate locations between the ends of said elongated element, said first and second support member being spaced from each other in said direction of elongation, and each support member comprising means providing a surface for engaging and supporting the underside of the one of said flanges which is not serving as one of said parallel supporting surfaces, means for engaging the side of said web underneath the last-mentioned flange at least at a location below said engaging and supporting surface, and means for preventing lateral movement of the upper end of said elongated element in a direction away from said side-engaging means, and in which at least one of said first and second support members also comprises means for preventing the flange which is not serving as one of said parallel supporting surfaces from being moved upwardly away from said engaging and supporting surfaces so long as said web-engaging means is in contact with said side of said web at a location below said engaging and supporting surface, whereby the weight of a bottle on said track means located adjacent the end thereof farthest from said one of said first and second support members is prevented from causing said elongated element from separating from said one of said first and second support members.

8. A merchandising device according to claim 5 in which said flanges extend from said web in opposite directions, and in which, at least adjacent one end of said elongated element, said first flange is separated from the edge of the web from which it extends, and is bent toward the opposite edge of the web to form a retarding ramp.

9. A merchandising device according to claim 8 in which, at least adjacent one end of the elongated element, said second flange is separated from the edge of the web from which it extends, and is bent toward the opposite edge of the web to form a retarding ramp.

10. A merchandising device according to claim 8 having tab means integrally formed at the end of said retarding ramp for engaging the neck ring of a bottle and requiring the lifting of a bottle for removal from the track means, thereby positively preventing bottles from accidentally becoming disengaged from the track means.

11. A merchandising device according to claim 5 in which said track means comprises a second removable elongated element substantially identical to said first elongated element and in which said supporting means and said track means include means for removably supporting said second elongated element in a first position in which its first flange serves as the other of said substantially parallel supporting surfaces and in a second position in which its second flange serves as the other of said substantially parallel supporting surfaces; in which the first and second flanges on each elongated element extend in opposite directions from the web; and in which, adjacent each end of each elongated element, each flange is separated from the edge of the web from which it extends and is bent toward the opposite edge of the web from which it extends to form a retarding ramp, the bent portions of each flange being symmetrical with respect to the flange; whereby said elongated elements are interchangeable.

* * * * *